US009643044B1

(12) United States Patent
Hsu

(10) Patent No.: US 9,643,044 B1
(45) Date of Patent: May 9, 2017

(54) DAMPING DEVICE FOR EXERCISE EQUIPMENT

(71) Applicant: GREAT FITNESS INDUSTRIAL CO., LTD., Tainan (TW)

(72) Inventor: Chih-Yung Hsu, Tainan (TW)

(73) Assignee: Great Fitness Industrial Co., Ltd., Tainan (TW)

( * ) Notice: Subject to any disclaimer, the term of this patent is extended or adjusted under 35 U.S.C. 154(b) by 0 days.

(21) Appl. No.: 14/957,939

(22) Filed: Dec. 3, 2015

(51) Int. Cl.
*A63B 24/00* (2006.01)
*A63B 22/00* (2006.01)
*A63B 21/04* (2006.01)

(52) U.S. Cl.
CPC ..... *A63B 22/0076* (2013.01); *A63B 21/0442* (2013.01); *A63B 24/0087* (2013.01); *A63B 2022/0079* (2013.01)

(58) Field of Classification Search
CPC . A63B 24/00; A63B 24/0062; A63B 24/0087; A63B 21/0442; A63B 21/015; A63B 21/0015; A63B 2022/0079; A63B 2022/001
See application file for complete search history.

(56) References Cited

U.S. PATENT DOCUMENTS 7,682,293 B2 * 3/2010 Eschenbach ..... A63B 21/015 482/51
7,686,743 B2 * 3/2010 Eschenbach ..... A63B 21/015 482/51
7,833,133 B2 * 11/2010 Stewart ..... A63B 22/001 482/52
8,597,163 B2 * 12/2013 Chiu ..... A63B 21/015 482/110
2001/0003110 A1 * 6/2001 Lay ..... A63B 21/0051 482/57

* cited by examiner

*Primary Examiner* — Glenn Richman
(74) *Attorney, Agent, or Firm* — Rosenberg, Klein & Lee

(57) ABSTRACT

A damping device for exercise equipment is disclosed. The damping device includes a transmission unit, a tension unit, and a resistance unit. The transmission unit has a driven shaft and a driving wheel mounted around a middle section of the driven shaft. The driven shaft has two ends thereof provided with a first rotating wheel and a second rotating wheel, respectively. The resistance unit includes a resistance fan and an adjustable resistance member located outside and below the first rotating wheel and the second rotating wheel, respectively, so as to structurally achieve overall weight balance. When the tension unit receives a push/pull force, a woven ribbon connected between the tension unit and the driving wheel drives the driven shaft to rotate the first and second rotating wheels, thereby making the resistance fan rotate and making the adjustable resistance member output even and adjustable resistance.

7 Claims, 8 Drawing Sheets

DAMPING DEVICE FOR EXERCISE EQUIPMENT

BACKGROUND OF THE INVENTION

1. Technical Field

The present invention relates to damping devices, and more particularly to a damping device designed for working with exercise equipment.

2. Description of Related Art

In recent years, with the prevalence of healthful exercise, increasing indoor fitness and exercise equipment are introduced to the market, such as treadmills, weight machines, exercise bikes, rowing machines and so on, for users to do physical training indoors regardless the weather.

Rowing machines are herein discussed for example. A conventional rowing machine typically includes a base, a slide rail installed on the base, a seat slidably mounted on the slide rail, a pair of pedals provided at one end of the base for positioning a user's feet, and a pair of paddles installed to the base at two sides of the seat for the user's two hands to operate like rowing a boat. In use, a user puts his/her feet against the pedals and holds the paddles in his/her hands to do push-and-pull movement like he/she is rowing a boat, so that the seat slide to and fro along the slide rail. Such a machine is intended to train the user's muscles in his/her arms, legs, chest, waist and back.

Some improvements have then been made to the conventional rowing machine. For example, Taiwan Patent No. 1249416, titled "IMPROVED FAN BLADES FOR MAGNETIC-CONTROL WHEEL" teaches a taking-up wheel and a magnetic-control wheel pivotally connected to and movably linked to an exercise machine's frame. The taking-up wheel includes a one-way bearing and acts as a wheel-type component that rotates in a single direction. On the axle of the taking-up wheel, there is a taking-up portion around which one end of a woven ribbon is wound so that the woven ribbon is fixed to the taking-up portion, and there is a wheel-belt portion adjacent to the taking-up portion. A driving belt has one end wound around the wheel-belt portion and an opposite end wound around the magnetic-control wheel at a corresponding site. The woven ribbon has its opposite end connected to a handle bar for a user to grip. In addition, a vane wheel is screwed to a lateral of the magnetic-control wheel. Since the blades of the vane wheel rotate along a path that is offset from the periphery of the magnetic-control wheel, when the vane wheel rotates with the magnetic-control wheel, a guiding air flow is formed as a result of application of centrifugal force and high-low pressure principle in conjunction with the intake space at the bottom of the blades. The air flow is guided according to fluid mechanics and effective in generating windage resistance, so as to increase damping for the magnetic-control wheel and provide proper resistance during a user's exercise.

However, the improved fan blades for the magnetic-control wheel works upon a user's movement of pulling and pushing the handle bar that drives the woven ribbon to rotate the taking-up wheel and in turn rotate the magnetic-control wheel and the vane synchronously through the driving belt. Since the driving belt drives the magnetic-control wheel and the vane wheel to perform synchronous rotation by means of one-stage transmission, the generated resistance is limited, and consequently the training effect is also limited.

SUMMARY OF THE INVENTION

Hence, one objective of the present invention is to provide a damping device for working with exercise equipment. The damping device is well balanced in weight and capable of providing even and adjustable resistance. Thereby, different training levels suitable for users having different levels of physical strength can be provided to make exercise training more effective.

To this end, the disclosed damping device is configured to be installed on exercise equipment that has a frame unit on which it stands on the ground, and the damping device comprises a transmission unit, a tension unit, and a resistance unit.

The transmission unit is attached to one end of the frame unit, and the transmission unit includes a driven shaft, a driving wheel mounted around a middle section of the driven shaft, a first rotating wheel pivotally connected to one end of the driven shaft, a second rotating wheel pivotally connected to an opposite end of the driven shaft, a woven ribbon that has one end fixed to the driving wheel and is wound around the driving wheel, a first driving belt, and a second driving belt. The first rotating wheel and the second rotating wheel are located at two reverse sides of the driving wheel, respectively.

The tension unit has a handle bar. The woven ribbon of the transmission unit has its opposite end connected to a middle section of the handle bar. When receiving a push/pull force, the handle bar drives the driving wheel and the driven shaft to rotate, thereby driving the first and second rotating wheels to rotate through the driven shaft.

The resistance unit includes a resistance fan that is located at one end of the frame unit and outside and below the first rotating wheel, and an adjustable resistance member that is located at the end of the frame unit and outside and below the second rotating wheel. The resistance fan has a fan wheel, and an axle that is coupled to the fan wheel and connected to the frame unit. The adjustable resistance member has a resistance generator connected to the frame unit, and a main shaft projecting from the resistance generator. The first driving belt of the transmission unit is connected between the first rotating wheel and the axle of the resistance fan. The second driving belt of the transmission unit is connected between the second rotating wheel and the main shaft of the adjustable resistance member. Thereby, when the first rotating wheel and the second rotating wheel rotate, they drive the axle and the main shaft to rotate respectively through the first driving belt and the second driving belt, and in turn drive the fan wheel rotate and drive the resistance generator of the adjustable resistance member to output resistance, respectively.

With the foregoing technical features, the following effects are achievable:

With the driving wheel of the transmission unit mounted around the middle section of the driven shaft, the first rotating wheel and the second rotating wheel coupled to two ends of the driven shaft and thereby located at two reverse sides of the driving wheel, respectively, and the resistance fan of the resistance unit and the adjustable resistance member located outside and below the first rotating wheel and the second rotating wheel, respectively, the entire structure is well balanced in weight. Also, when the tension unit receives a push/pull force, it can synchronously drive the first rotating wheel and the second rotating wheel to rotate through the woven ribbon, the driving wheel, and the driven shaft, and further to drive the fan wheel and the adjustable resistance member to output even and adjustable resistance. Thereby, different training levels suitable for users having different levels of physical strength can be provided to make exercise training more effective.

DETAILED DESCRIPTION OF THE INVENTION

The following preferred embodiments when read with the accompanying drawings are made to clearly exhibit the above-mentioned and other technical contents, features and effects of the present invention. Unless otherwise noted, like elements will be identified by identical numbers throughout all figures.

Figure 1:
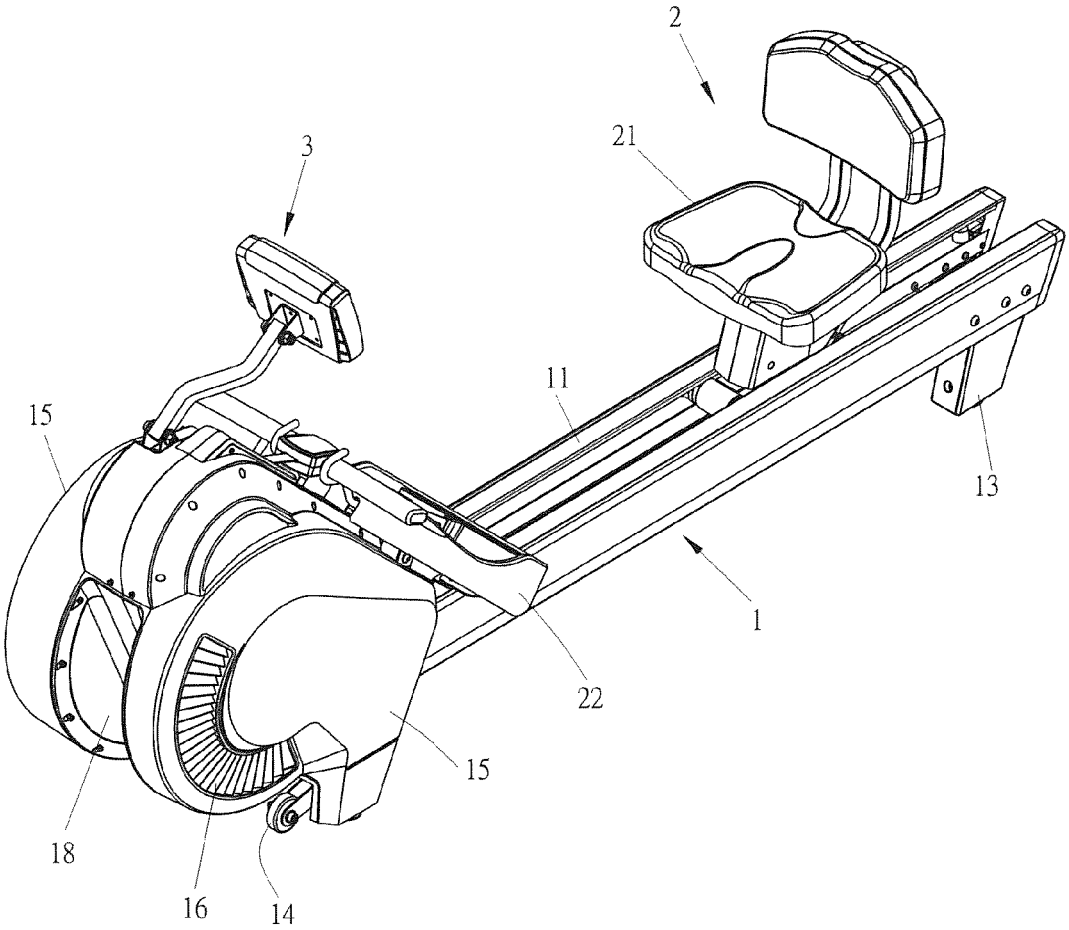
FIG. 1 is a perspective view of exercise equipment having a damping device according to a first embodiment of the present invention.
Figure 2:
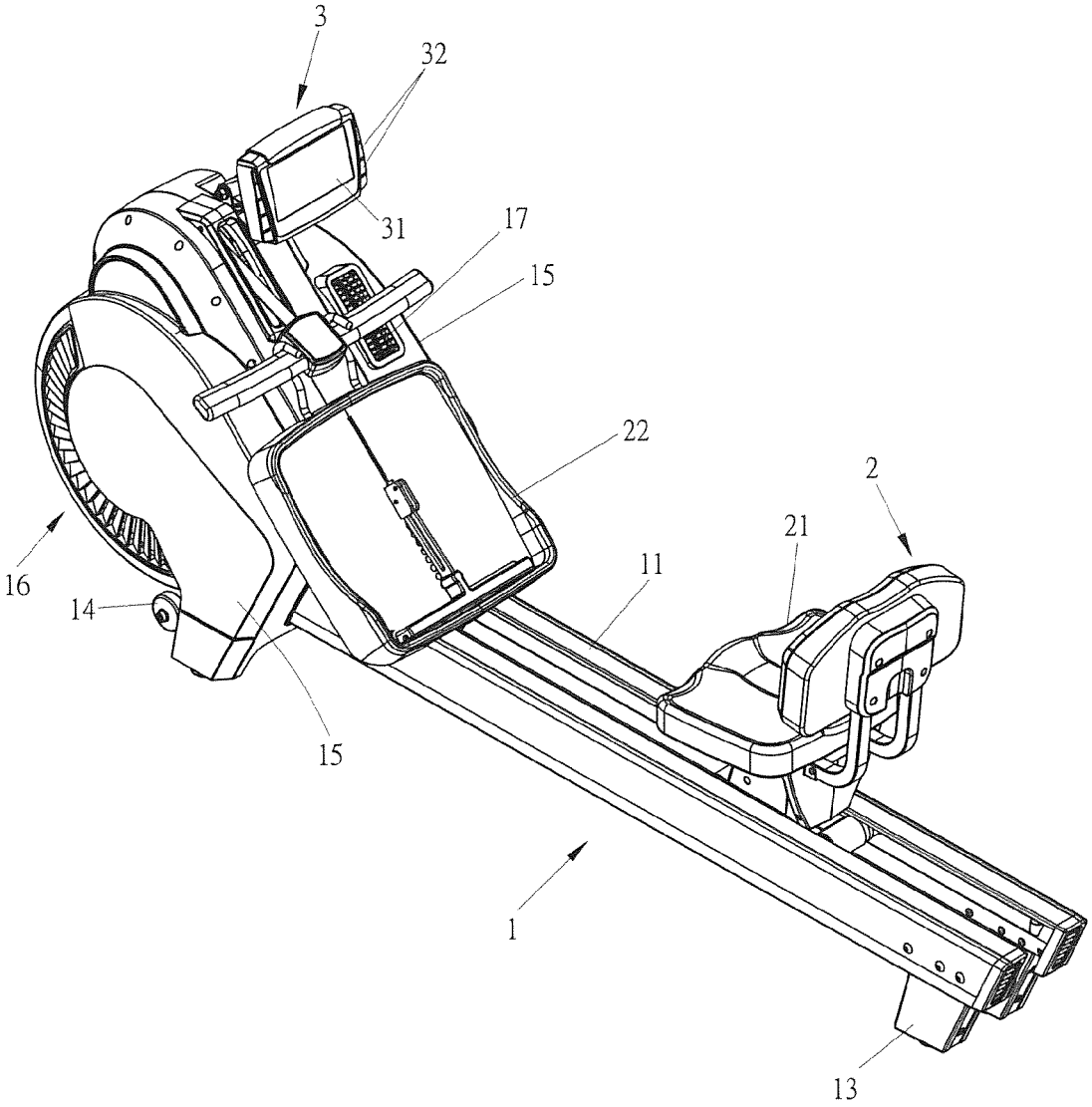
FIG. 2 is another perspective view of the exercise equipment of FIG. 1 taken from a different viewpoint.
Figure 3:
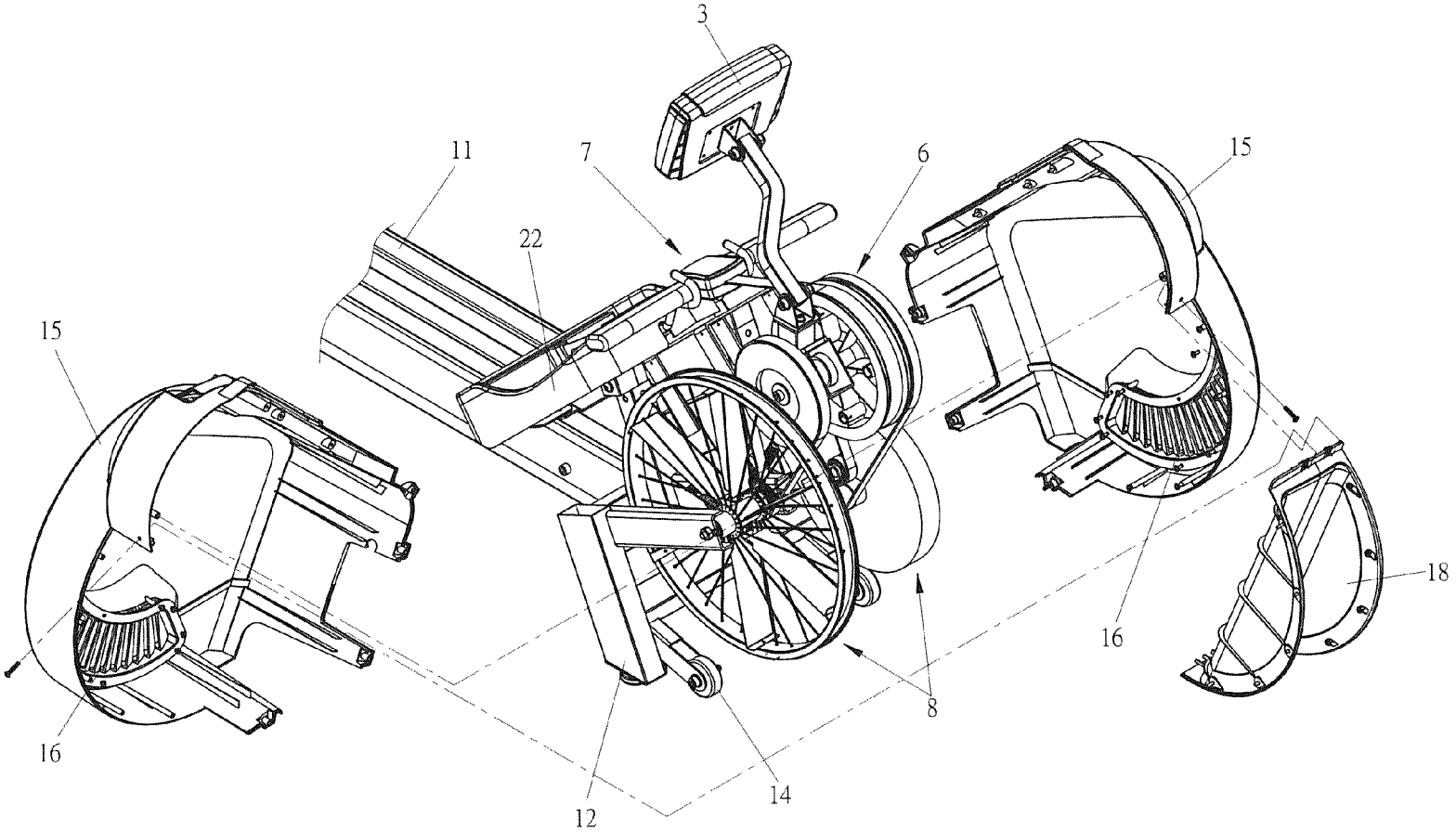
FIG. 3 a disassembled view of a part of the damping device of FIG. 1.

Referring to FIGS. 1, 2 and 3, according to the first embodiment of the present invention, a damping device is designed for working with exercise equipment that may be but not limited to a rowing machine as depicted. The exercise equipment comprises a frame unit 1 on which it stands on the ground, a loading unit 2, a user interface unit 3 mounted on the frame unit 1, a motor 4 (shown in FIG. 6), and a power storing unit 5 electrically connected to the motor 4 (shown in FIG. 6). The motor 4 has an output portion (not shown). The frame unit 1 includes a guiding rail assembly 11, a positioning frame 12 located at one end of the guiding rail assembly 11, two separate feet 13 supporting an opposite end of the guiding rail assembly 11 from below, two separate wheels 14 supporting the positioning frame 12 from below, two shells 15 that are combined to enclose the positioning frame 12, two inlet grilles 16 each formed on a respective one of the shells 15, an outlet grille 17 formed on one of the shells 15 and facing the loading unit 2, and a front cover 18 connected between the shells 15. The loading unit 2 includes a seat 21 that is slidably mounted on the guiding rail assembly 11 and a pedal 22 that is disposed on the guiding rail assembly 11 and adjacent to the positioning frame 12. The user interface unit 3 is mounted on the positioning frame 12 and located above the damping device. The user interface unit 3 has a display screen 31 and a plurality of operational buttons 32 provided beside the display screen 31 for a user to operate and input instruction. The user interface unit 3 may be preprogrammed with a non-automatic mode and an automatic mode between which the user can select using proper operational buttons 32. In the automatic mode, the user may further set a resistance value using proper operational buttons 32, so as to determine how much resistance shall be generated by the damping device. In the non-automatic mode, the resistance generated by the damping device is determined by a push/pull force applied by the user. It is to be noted that the user interface unit 3 is not limited to what is illustrated, and may alternatively be a touch screen. In the latter case, the user can easily input operational instruction by touching options shown in the screen.

Figure 4:
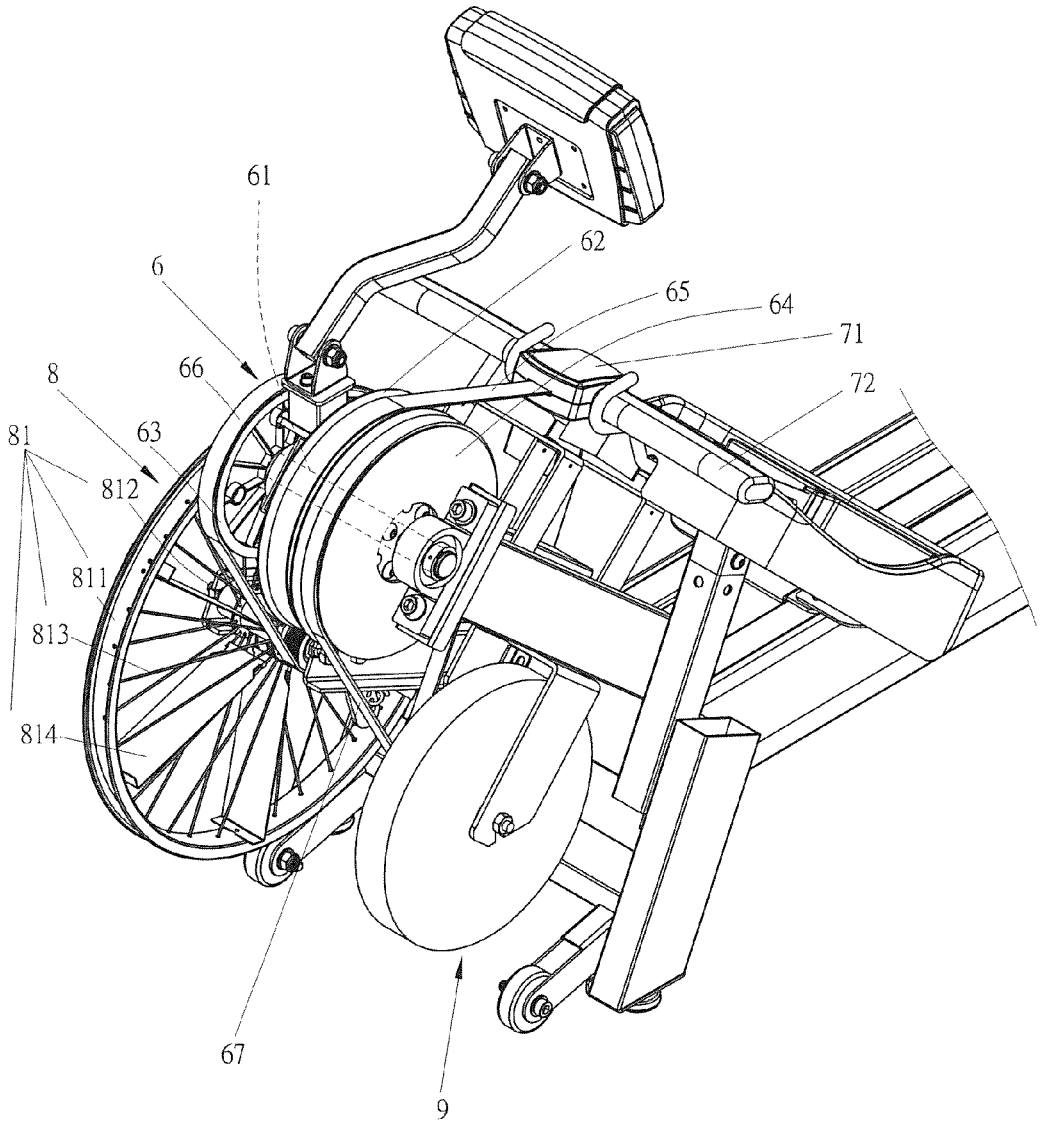
FIG. 4 is a perspective view of a part of the damping device of FIG. 1.
Figure 5:
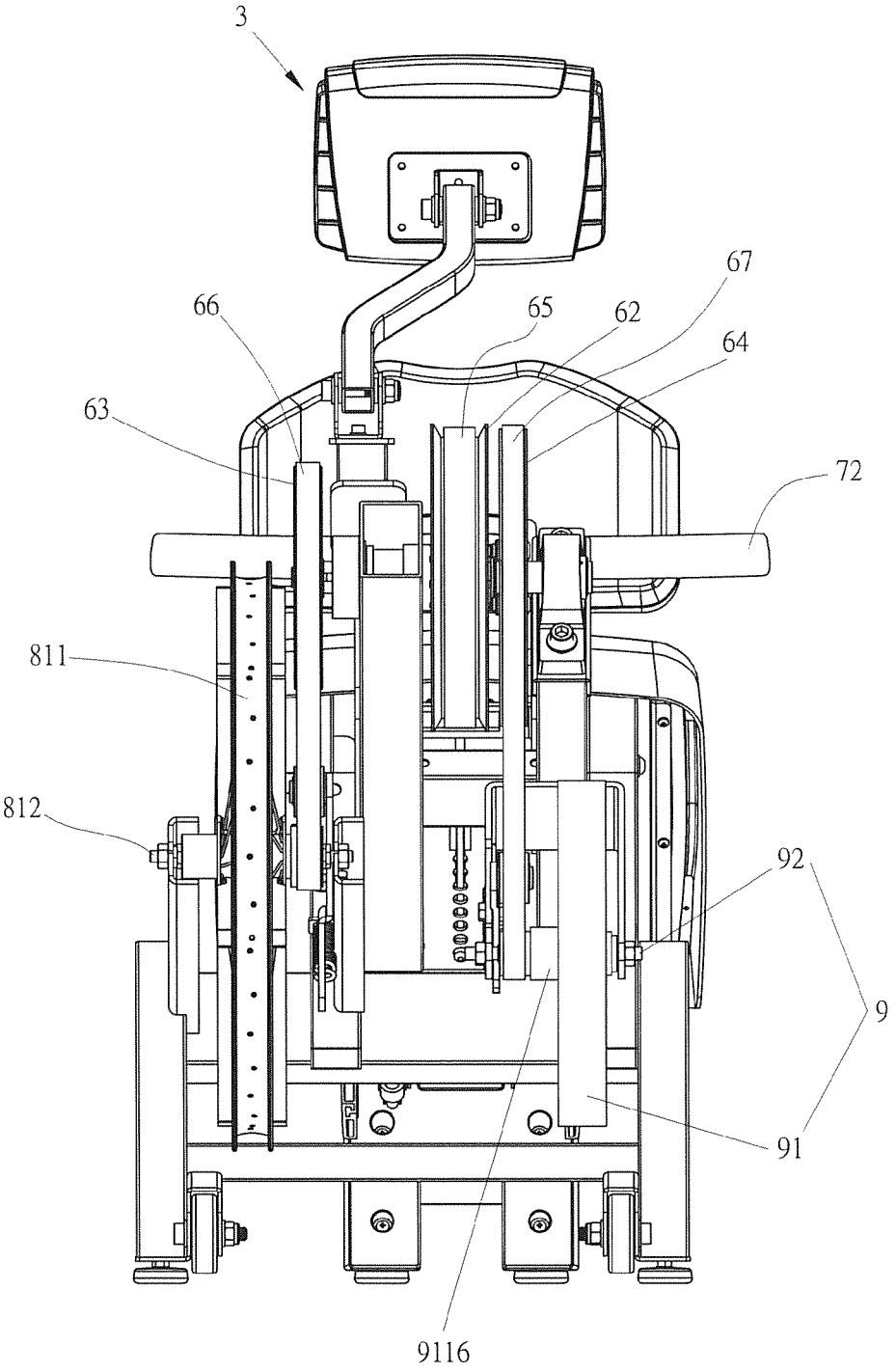
FIG. 5 is a front view of the exercise equipment of FIG. 1, particularly illustrating the damping device of FIG. 4.

Referring to FIGS. 3, 4 and 5, the damping device comprises a transmission unit 6, a tension unit 7, and a resistance unit 8. The transmission unit 6 includes a driven shaft 61 mounted on the positioning frame 12, a driving wheel 62 mounted around a middle section of the driven shaft 61, a first rotating wheel 63 pivotally connected to one end of the driven shaft 61, a second rotating wheel 64 pivotally connected to an opposite end of the driven shaft 61, a woven ribbon 65 having one end thereof fixed to the driving wheel 62 and being wound around the driving wheel 62, a first driving belt 66, and a second driving belt 67. The first rotating wheel 63 and the second rotating wheel 64 are located at two reverse sides of the driving wheel 62, respectively.

The tension unit 7 has a base 71 and a handle bar 72 passing through the base 71. The woven ribbon 65 of the transmission unit 6 has its opposite end connected to a middle section of the handle bar 72. Thereby, when the handle bar 72 receives a push/pull force applied thereon, it tensions the woven ribbon 65 or makes the woven ribbon 65 wound around the driving wheel 62, thereby driving the driving wheel 62 to rotate.

Referring to FIGS. 3, 4 and 5, the resistance unit 8 includes a resistance fan 81 and an adjustable resistance member 9. The resistance fan 81 is located outside and below the first rotating wheel 63. The adjustable resistance member 9 is located outside and below the second rotating wheel 64. The resistance fan 81 has a fan wheel 811 and an axle 812 passing through the fan wheel 811 and connected to the frame unit 1. The fan wheel 811 has a hub-spoke assembly 813 and a plurality of resistance pieces 814. The plurality of resistance pieces 814 are separately provided inside the hub-spoke assembly 813. The axle 812 passes through the center of the hub-spoke assembly 813 and has two ends thereof rotatably connected to the positioning frame 12, so that the axle 812 is allowed to rotate with respect to the positioning frame 12, thereby driving the fan wheel 811 to rotate.

Figure 6:
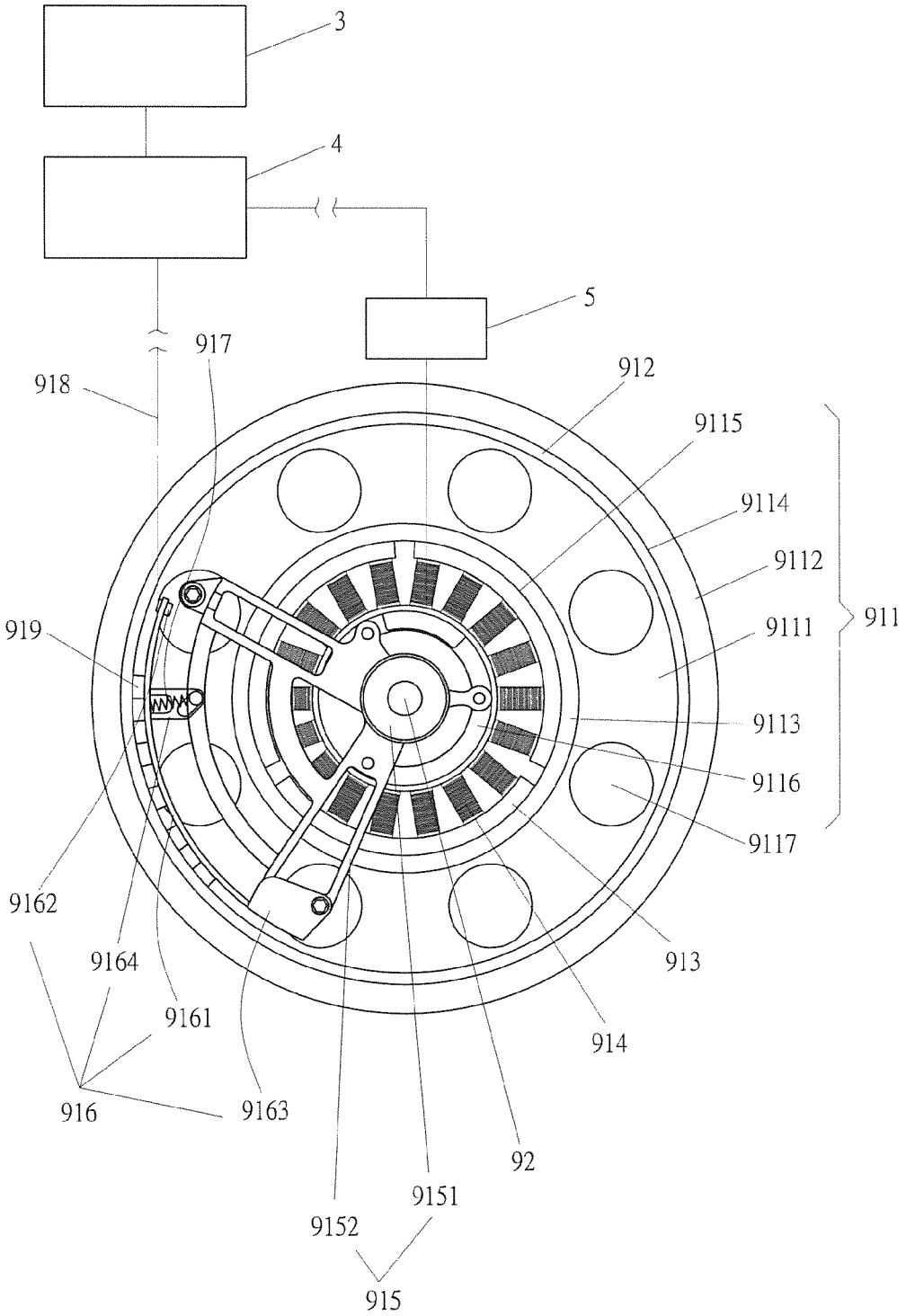
FIG. 6 schematically illustrates a resistance generator of an adjustable resistance member according to the first embodiment, and how the resistance generator is connected to a user interface unit, a motor and a power storing unit.

Referring to FIGS. 5 and 6, the adjustable resistance member 9 has a resistance generator 91 and a main shaft 92. The resistance generator 91 is connected to the frame unit 1. The main shaft 92 projects from the resistance generator 91. The resistance generator 91 includes a hollow housing 911 rotatably mounted around the main shaft 92, a fixing ring 912 located in the hollow housing 911, a plurality of magnetic plates 913 arranged into a circle in the hollow housing 911 and separated from the fixing ring 912, a plurality of coil assemblies 914 arranged into a circle inside the magnetic plates 913 and circling the main shaft 92, a lateral connector 915, a working member 916, a returning member 917, a drawing cord 918 having one end thereof connected to the output portion (not shown) of the motor 4, and at least one magnet 919.

The hollow housing 911 has a central wall 9111, an annular outer wall 9112 disposed on the central wall 9111, an annular inner wall 9113 disposed on the central wall 9111 and separated from the annular outer wall 9112, an annular outer groove 9114 defined jointly by the central wall 9111, the annular inner wall 9113 and the annular outer wall 9112, an annular inner groove 9115 defined jointly by the central wall 9111 and the annular inner wall 9113, a sleeve 9116 disposed on the central wall 9111 and located in the annular inner groove 9115 for the main shaft 92 to pass therethrough, and a plurality of heat-dissipating holes 9117 formed separately on the central wall 9111 and located in the annular outer groove 9114. The fixing ring 912 is located in the annular outer groove 9114 of the hollow housing 911 and closely contacts an inner surface of the annular outer wall 9112. The magnetic plates 913 are located in the annular inner groove 9115 of the hollow housing 911 and closely contact an inner surface of the annular inner wall 9113. The coil assemblies 914 are arranged into a circle and located between the sleeve 9116 and the inner surface of the annular inner wall 9113, so as to circle the main shaft 92. In addition, the lateral connector 915 has a fixing portion 9151 and a joining portion 9152. The fixing portion 9151 is fixed to the sleeve 9116, and the joining portion 9152 sectorially extends out from the fixing portion 9151. The working member 916 has a carrier 9161, a positioning portion 9162 located at one end of the carrier 9161 and connected to an opposite end of the drawing cord 918, a connecting portion 9163 located at an opposite end of the carrier 9161 for combining with the joining portion 9152 of the lateral connector 915, and a retaining portion 9164 disposed on the carrier 9161 and located between the positioning portion 9162 and the connecting portion 9163. Additionally, the returning member 917 is connected between the joining portion 9152 and the carrier 9161 and located inside the retaining portion 9164. The magnet 919 is affixed to an outer lateral of the carrier 9161 and faces the fixing ring 912. While plural magnets 919 are used in the present embodiment, other embodiments may use only one magnet in the form of a curved plate. Tension of the drawing cord 918 is controlled by rotation of the motor 4, and in turn makes the carrier 9161 move toward or away from the fixing ring 912, thereby changing the distance between the magnets 919 and the fixing ring 912 and eventually adjusting damping.

Figure 7:
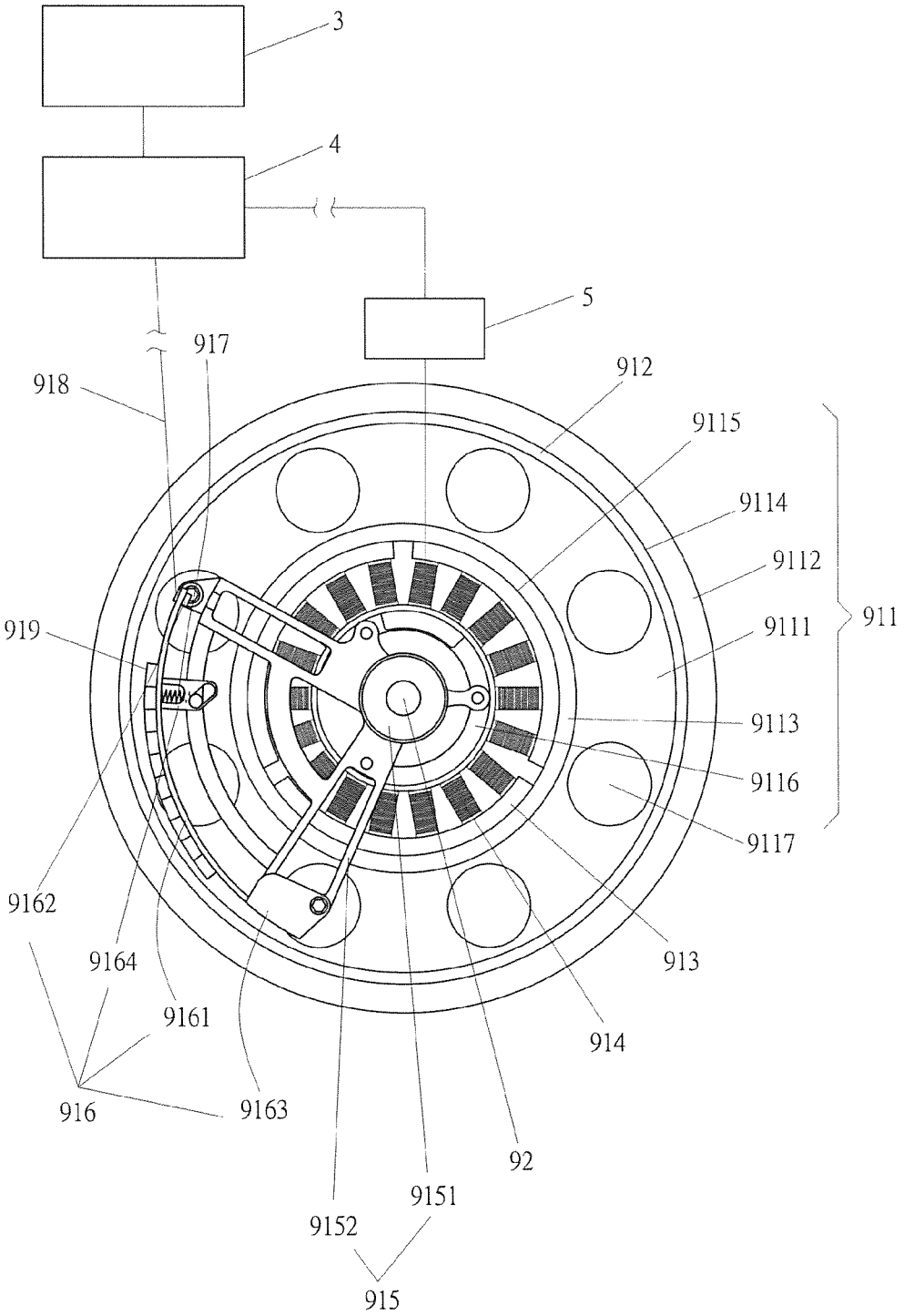
FIG. 7 schematically shows that when a drawing cord in the first embodiment is tensioned, magnets on a carrier become further apart from the fixing ring.

Referring to FIGS. 5, 6 and 7, the coil assemblies 914 are electrically connected to the power storing unit 5, and the motor 4 is electrically connected to the user interface unit 3. In use, a user may input his/her operational instruction using the operational buttons 32. After selection and settings are made, the motor 4 starts to operate and control tension of the drawing cord 918. In FIG. 7, the drawing cord 918 is tensioned and drives the carrier 9161 to move away from the fixing ring 912, so that the distance between the magnets 919 and the fixing ring 912 is increased, meaning that the resultant damping is decreased. At this time, the returning member 917 is compressed and stores up a returning force. By contrast, when the drawing cord 918 is released, the carrier 9161 is driven to move toward the fixing ring 912, so that the distance between the magnets 919 and the fixing ring 912 is decreased, meaning that the resultant damping is increased. More specifically, when the drawing cord 918 is released, the returning member 917 releases the returning force it stores, and in turn drives the carrier 9161 to move toward the fixing ring 912 and to even return to its initial position.

Referring to FIGS. 4, 5, 6 and 7, the first driving belt 66 of the transmission unit 6 is connected between the first rotating wheel 63 and the axle 812 of the resistance fan 811, and the second driving belt 67 of the transmission unit 6 is connected between the second rotating wheel 64 and the main shaft 92 of the adjustable resistance member 9. In the respect of operation, when the handle bar 72 held by a user receives a push/pull force, it tensions the woven ribbon 65 or makes the woven ribbon 65 wound around the driving wheel 62, thereby driving the driving wheel 62 to coaxially rotate the first rotating wheel 63 and the second rotating wheel 64, and further driving the first driving belt 66 and the second driving belt 67 to move and, respectively, make the axle 812 of the resistance fan 81 and the main shaft 92 of the adjustable resistance member 9 rotate. As a result, the fan wheel 811 of the resistance fan 81 is driven to rotate, and draws air from the exterior into the space enclosed by the shells 15 and the front cover 18 through the inlet grille 16. The air is then output at the outlet grille 17 as a puff of wind acting on the user. (The inlet grille 16, the outlet grille 17, the shells 15 and the front cover 18 are shown in FIG. 1 and FIG. 2.) The wind provides not only auxiliary resistance when the user exercises, but also simulation of outdoor breeze, making the exercise more joyful. Meanwhile, the rotation of the main shaft 92 also drives the hollow housing 911 of the resistance generator 91 to rotate, thereby making the magnetic plates 913 displace with respect to the coil assemblies 914. As a result, the variation in terms of magnetic flux makes the coil assemblies 914 generate an induced current and therefore power that can used to power the user interface unit 3 or the display screen 31 (as shown in FIG. 2), and to charge the power storing unit 5 that powers the motor 4.

Figure 8:
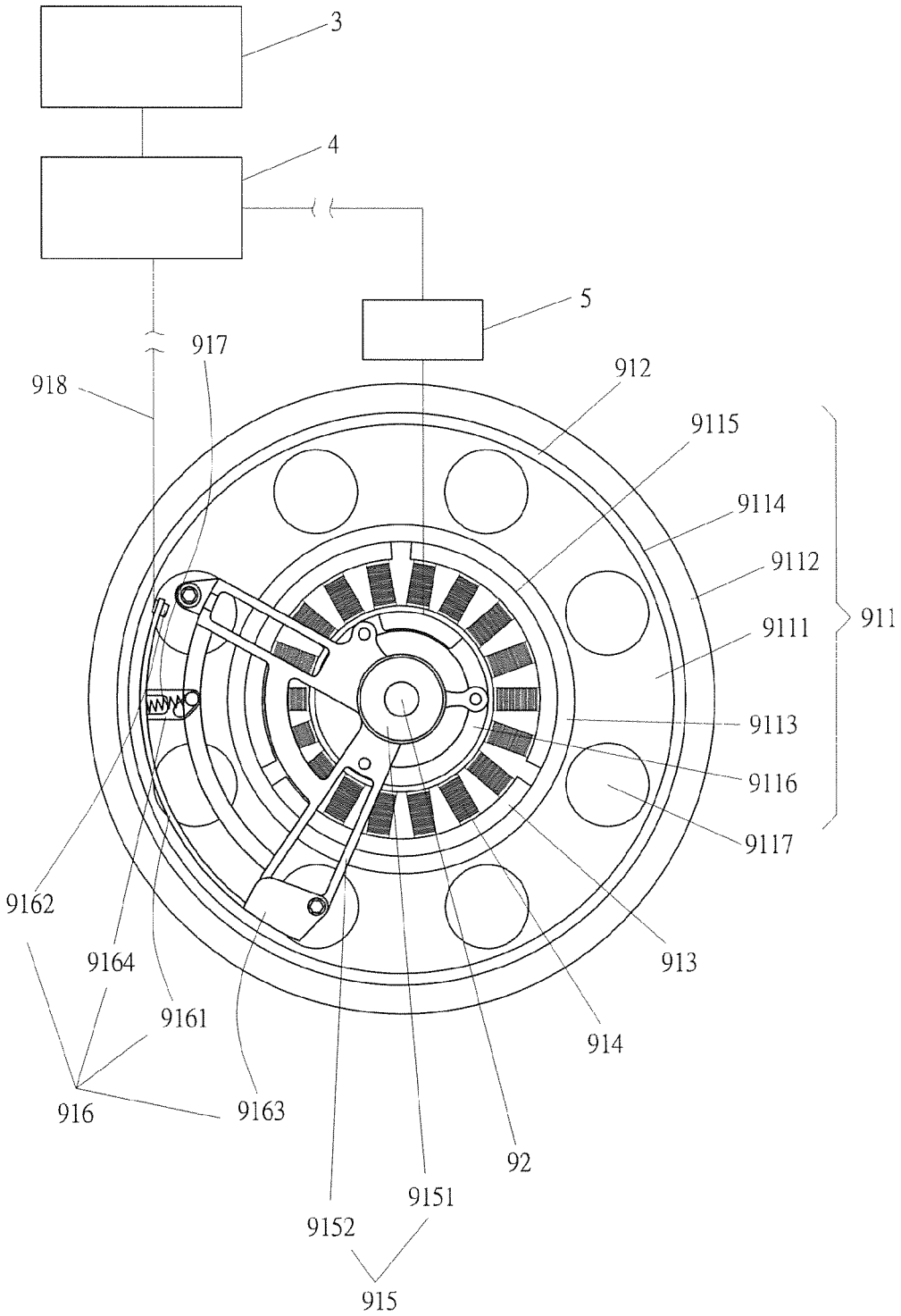
FIG. 8 depicts a damping device according to a second embodiment of the present invention.

Referring to FIG. 8, in the second embodiment of the present invention, the damping device is similar to its counterpart as described in the first embodiment except that the adjustable resistance member 9 contains no magnets 919 as shown in FIG. 7. In use, the outer lateral of the carrier 9161 contacts the inner surface of the fixing ring 912 directly, so damping is provided by the friction generated therebetween.

To sum up, with the driving wheel 62 of the transmission unit 6 mounted around the middle section of the driven shaft 61, the first rotating wheel 63 and the second rotating wheel 64 coupled to two ends of the driven shaft 61 and thereby located at two reverse sides of the driving wheel, respectively, and the resistance fan 81 of the resistance unit 8 and the adjustable resistance member 9 of the resistance unit 8 located outside and below the first rotating wheel 63 and the second rotating wheel 64, respectively, the entire structure is well balanced in weight. Also, when the tension unit 7 receives a push/pull force, it can synchronously drive the first rotating wheel 63 and the second rotating wheel 64 to rotate through the driving belt, the driving wheel 62, and the driven shaft 61, and further to drive the fan wheel 811 and the adjustable resistance member 9 to output even and adjustable resistance. It is to be noted that the present invention implements two-stage transmission that is capable of generating resistance greater than that of one-stage transmission as provided in the prior art, and the greater resistance may be used to provide more effective training. Thereby, different training levels suitable for users having different levels of physical strength can be provided to make exercise training more effective.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A damping device for working with exercise equipment that stands on the ground with a frame unit, the damping device comprising:

a transmission unit, being installed at one end of the frame unit and including a driven shaft, a driving wheel mounted around a middle section of the driven shaft, a first rotating wheel pivotally connected to one end of the driven shaft, a second rotating wheel pivotally connected to an opposite end of the driven shaft, a woven ribbon having one end thereof fixed to the driving wheel and being wound around the driving wheel, a first driving belt, and a second driving belt, wherein the first rotating wheel and the second rotating wheel are located at two reverse sides of the driving wheel, respectively;

a tension unit, having a handle bar, in which the woven ribbon of the transmission unit has its opposite end connected to a middle section of the handle bar, so that when receiving a push/pull force, the handle bar drives the driving wheel and the driven shaft to rotate, and in turn drives the first rotating wheel and the second rotating wheel to rotate through the driven shaft; and a resistance unit, including a resistance fan provided at the end of the frame unit and located outside and below the first rotating wheel, and an adjustable resistance member provided at the end of the frame unit and located outside and below the second rotating wheel, the resistance fan having a fan wheel and an axle passing through the fan wheel and connected to the frame unit, the adjustable resistance member having a resistance generator connected to the frame unit and a main shaft projecting from the resistance generator, the first driving belt of the transmission unit being connected between the first rotating wheel and the axle of the resistance fan, and the second driving belt of the transmission unit being connected between the second rotating wheel and the main shaft of the adjustable resistance member, whereby when rotating, the first rotating wheel and the second rotating wheel drive the axle and the main shaft to rotate, respectively, by means of the first driving belt and the second driving belt, thereby driving the fan wheel to rotate and making the resistance generator of the adjustable resistance member output resistance.

2. The damping device of claim 1, wherein the resistance generator includes a hollow housing rotatably mounted around the main shaft, a fixing ring located in the hollow housing, a plurality of magnetic plates arranged into a circle in the hollow housing and separated from the fixing ring, a plurality of coil assemblies arranged into a circle inside the magnetic plates and circling the main shaft, a lateral connector, a working member, a returning member, a drawing cord having one end thereof connected to an output portion of a motor of the exercise equipment, and at least one magnet, the lateral connector having a fixing portion fixed to the main shaft and a joining portion sectorially extending out from the fixing portion, the working member having a carrier, a positioning portion located at one end of the carrier and connected to an opposite end of the drawing cord, a connecting portion located at an opposite end of the carrier for combining with the joining portion of the lateral connector, and a retaining portion disposed on the carrier and located between the positioning portion and the connecting portion, the returning member being connected between the joining portion and the carrier and located inside the retaining portion, and the magnet being located outside the carrier and facing the fixing ring, whereby rotation of the motor controls tension of the drawing cord, thereby driving the carrier to move away from or toward the fixing ring, so as to change a distance between the magnet and the fixing ring and thus adjust damping.

3. The damping device of claim 2, wherein the exercise equipment further comprises a power storing unit electrically connected to the motor, and the coil assemblies are electrically connected to the power storing unit, whereby when the magnetic plates move with the hollow housing and displace with respect to the coil assemblies, the coil assemblies generate an induced current and thereby generate power that charges the power storing unit and in turn powers the motor.

4. The damping device of claim 3, wherein the frame unit includes a guiding rail assembly and a positioning frame mounted on one end of the guiding rail assembly, and the fan wheel of the resistance fan has a hub-spoke assembly and a plurality of resistance pieces separately provided inside the hub-spoke assembly, in which the axle passes through a center of the hub-spoke assembly and has two ends thereof rotatably connected to the positioning frame, so that the axle is allowed to rotate with respect to the positioning frame, thereby driving the fan wheel to rotate.

5. The damping device of claim 2, wherein the hollow housing has a central wall, an annular outer wall disposed on the central wall, an annular inner wall disposed on the central wall and separated from the annular outer wall, an annular outer groove defined jointly by the central wall, the annular inner wall, and the annular outer wall, an annular inner groove defined jointly by the central wall and the annular inner wall, a sleeve disposed on the central wall and located in the annular inner groove for the main shaft to pass therethrough, and a plurality of heat-dissipating holes formed separately on the central wall and located in the annular outer groove, and the fixing ring is located in the annular outer groove of the hollow housing and closely contacts an inner surface of the annular outer wall, in which the magnetic plates are located in the annular inner groove of the hollow housing and closely contact an inner surface of the annular inner wall, and the coil assemblies are arranged into a circle and located between the sleeve and the inner surface of the annular inner wall.

6. The damping device of claim 3, wherein the hollow housing has a central wall, an annular outer wall disposed on the central wall, an annular inner wall disposed on the central wall and separated from the annular outer wall, an annular outer groove defined jointly by the central wall, the annular inner wall, and the annular outer wall, an annular inner groove defined jointly by the central wall and the annular inner wall, a sleeve disposed on the central wall and located in the annular inner groove for the main shaft to pass therethrough, and a plurality of heat-dissipating holes formed separately on the central wall and located in the annular outer groove, and the fixing ring is located in the annular outer groove of the hollow housing and closely contacts an inner surface of the annular outer wall, in which the magnetic plates are located in the annular inner groove of the hollow housing and closely contact an inner surface of the annular inner wall, and the coil assemblies are arranged into a circle and located between the sleeve and the inner surface of the annular inner wall.

7. The damping device of claim 2, wherein the exercise equipment further comprises a user interface unit that has a display screen and a plurality of operational buttons provided beside the display screen for a user to operate and input instruction, in which the user interface unit is mounted on the positioning frame and located above the damping device, whereby the instruction input through the operational buttons controls the motor's rotation rate and the drawing cord's tension, thereby adjusting damping.

* * * * *